US011412815B1

(12) United States Patent
Sereg-Mangano

(10) Patent No.: US 11,412,815 B1
(45) Date of Patent: Aug. 16, 2022

(54) FOOT THERAPY SYSTEM

(71) Applicant: Kathrine Sereg-Mangano, Middle Village, NY (US)

(72) Inventor: Kathrine Sereg-Mangano, Middle Village, NY (US)

( * ) Notice: Subject to any disclaimer, the term of this patent is extended or adjusted under 35 U.S.C. 154(b) by 137 days.

(21) Appl. No.: 17/075,266

(22) Filed: Oct. 20, 2020

Related U.S. Application Data

(60) Provisional application No. 62/963,618, filed on Jan. 21, 2020.

(51) Int. Cl.
*A43B 7/26* (2006.01)
*A43B 17/00* (2006.01)
*A43B 7/145* (2022.01)

(52) U.S. Cl.
CPC ..... *A43B 17/00* (2013.01); *A43B 7/145* (2013.01); *A43B 7/26* (2013.01)

(58) Field of Classification Search
CPC ..... A43B 7/1465; A43B 7/26; A43B 7/145
USPC ..... 36/155, 160, 163, 161
See application file for complete search history.

(56) References Cited

U.S. PATENT DOCUMENTS 1,061,353 A * 5/1913 Block ..... A43B 7/22 36/163
1,944,608 A * 1/1934 Noble ..... A43B 7/1464 36/163
2,036,890 A * 4/1936 Slater ..... A43B 7/22 36/180
2,311,925 A * 2/1943 Boos ..... A43B 7/1445 36/DIG. 1
4,207,880 A * 6/1980 Zinkovich ..... A43B 7/26 36/94
4,408,402 A 10/1983 Looney
4,633,877 A 1/1987 Pendergast
4,841,648 A * 6/1989 Shaffer ..... A43B 17/00 36/43
5,400,528 A * 3/1995 Skinner ..... A43B 7/1464 36/161
5,768,803 A 6/1998 Levy
5,806,208 A 9/1998 French
5,946,823 A * 9/1999 Yates ..... A43B 7/26 36/94
7,210,250 B2 5/2007 Gallegos
7,380,352 B2 6/2008 Setter
(Continued)

*Primary Examiner* — Marie D Bays
(74) *Attorney, Agent, or Firm* — Goldstein Law Offices, P.C.

(57) ABSTRACT

A modular shoe insole is disclosed. The insole includes discrete therapeutic components that are removably attachable to a support frame for customization to selectively target and provide therapeutic relief to specific areas of the foot. The therapeutic components include a first-toe support member corresponding to the big toe, a second-to-fifth-toe support member corresponding to the second through fifth toes, a ball-of-foot support member corresponding to the ball of the foot, an arch support member corresponding to the arch of the foot, a heel support member corresponding to the heel of the foot, toe dividers for separating the second through fifth toes, and a heel guard for protecting the heel from the back of a shoe. Addition or removal of a therapeutic component from the support frame enables individuals to target the specific area of the foot that corresponds to the therapeutic component.

19 Claims, 6 Drawing Sheets

(56) References Cited

U.S. PATENT DOCUMENTS

| | | | | |
|---|---|---|---|---|
| 7,644,522 | B2 * | 1/2010 | Ramirez | A43B 17/00 36/43 |
| 8,453,346 | B2 | 6/2013 | Steszyn | |
| 8,667,715 | B2 | 3/2014 | Santaopietro | |
| D737,559 | S | 9/2015 | Mungo | |
| 2006/0059726 | A1 | 3/2006 | Song | |
| 2007/0033834 | A1 * | 2/2007 | Cheskin | A43B 7/223 36/28 |
| 2007/0294922 | A1 * | 12/2007 | Ma | A43B 7/1464 36/142 |
| 2012/0023776 | A1 | 2/2012 | Skaja | |
| 2013/0104419 | A1 * | 5/2013 | Horesh | A43B 7/141 36/43 |
| 2015/0237959 | A1 * | 8/2015 | Wynn | A43B 13/188 12/146 M |
| 2016/0021972 | A1 * | 1/2016 | Grelle | A43B 13/12 36/140 |

* cited by examiner

FOOT THERAPY SYSTEM

CROSS-REFERENCE TO RELATED APPLICATIONS

This application claims the benefit of priority of U.S. Provisional Patent Application Ser. No. 62/963,618, filed on Jan. 21, 2020, the contents of which are relied upon and incorporated herein by reference in their entirety.

TECHNICAL FIELD

The present disclosure relates generally to foot therapy systems. More particularly, the present disclosure relates to a foot therapy system including a shoe and a modular shoe insole having various therapeutic components corresponding to different areas of the foot that enable individuals to customize the shoe insole to provide relief to specific areas of their feet.

BACKGROUND

Foot fatigue is one of the most common conditions affecting individuals on a daily basis and is exacerbated by common painful foot conditions such as arthritis, gout, plantar fasciitis, and tendinitis. It is particularly common in individuals who have long commutes to work, stand for prolonged periods of time, engage in sports or exercise, and exert a lot of pressure on their feet. Indeed, these individuals have no convenient and efficient means for providing therapeutic relief to their feet while still remaining active and on the go. Typically, individuals use known shoe insoles to obtain relief from foot fatigue.

Shoe insoles are commonly used devices that are useful for increasing the comfort of shoes and prolonging the useful lifetime of the shoe. Indeed, shoe insoles are commonly designed as orthotic devices suitable for alleviating foot fatigue and painful foot conditions, such as arthritis, gout, bunions, corns, calluses, ingrown toenails, high arch, low arch, Achilles tendinitis, plantar fasciitis, and heel spurs, among others. These devices, though relatively inexpensive, are disadvantageous because they provide relief that is limited to certain conditions and/or specific areas of the foot. Thus, users are required to purchase multiple different insoles to provide relief to different conditions and multiple areas of the foot. The few available shoe insoles that provide relief for many conditions and different areas of the foot are disadvantageous because they provide no means for removing the component of the insole that is directed to a certain condition or portion of the foot. Moreover, they do not provide a means for customizing the insole to target specific areas of the foot that require therapeutic relief of a condition, pain, or discomfort. Additionally, they do not provide a heat and/or cold therapy treatment means. Even more, these insoles are typically stand-alone devices and do not provide a comfortable spa-like shoe in an all-in-one foot therapy system.

Accordingly, there is a need for a foot therapy system that includes a comfortable spa-like shoe and a modular insole having various discrete components corresponding to the main regions of the foot that provide a user a means of interchanging the components to obtain therapeutic relief to specific areas of the foot.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide foot therapy system that provides therapeutic relief to various areas of the foot to help alleviate certain foot conditions, pain, or discomfort. Accordingly, the present disclosure provides a shoe including a modular insole having various therapeutic components corresponding to the first toe of a foot, the second to fifth toes of a foot, the ball of the foot, the arch of a foot, and the heel of a foot.

An aspect of an example embodiment of the present disclosure is to provide a foot therapy system including an insole having a means for customizing the insole to selectively target specific areas of the foot to obtain therapeutic relief to those specific areas only. Accordingly, the present disclosure provides a modular insole in which the various therapeutic components are discrete in that they are separate and distinct from one another.

An aspect of an example embodiment of the present disclosure is to provide an all-in-one foot therapy system including a comfortable spa-like shoe and shoe insole for the purpose of providing therapeutic relief on the go. Accordingly, the present disclosure provides a modular insole and a shoe that is configured to receive the modular insole.

An aspect of an example embodiment of the present disclosure is to provide a shoe insole having a means for removably attaching the various therapeutic components in order to customize the shoe insole as desired to selectively target specific areas of the foot. Accordingly, the present disclosure provides a support frame including a fastener for removably attaching the various therapeutic components to the shoe insole as desired.

An aspect of an example embodiment of the present disclosure is to provide a shoe insole that alleviates conditions, pain, or discomfort in a user's first toe independently. Accordingly, the present disclosure provides a shoe insole in which one of the various therapeutic components includes a discrete first-toe support member that is removably attachable to the support frame for providing therapeutic relief to a condition, pain, or discomfort of a user's first toe.

An aspect of an example embodiment of the present disclosure is to provide a shoe insole that alleviates conditions, pain, or discomfort in a user's second through fifth toes independently. Accordingly, the present disclosure provides a shoe insole in which the various therapeutic components include a discrete second-to-fifth-toe support member that is removably attachable to the support frame and one or more discrete toe dividers removably attachable to the second-to-fifth-toe support member for providing therapeutic relief to a condition, pain, or discomfort of at least one of a user's second through fifth toes.

An aspect of an example embodiment of the present disclosure is to provide a shoe insole that alleviates conditions, pain, or discomfort in a user's ball of the foot. Accordingly, the present disclosure provides a shoe insole in which one of the various therapeutic components includes a discrete ball-of-foot support member for providing therapeutic relief to a condition, pain, or discomfort of a user's ball of the foot.

An aspect of an example embodiment of the present disclosure is to provide a shoe insole that alleviates conditions, pain, or discomfort in a user's arch. Accordingly, the present disclosure provides a shoe insole in which one of the various components includes a discrete arch support member for providing therapeutic relief to a condition, pain, or discomfort of a user's arch.

An aspect of an example embodiment of the present disclosure is to provide a shoe insole that alleviates conditions, pain, or discomfort in a user's heel. Accordingly, the present disclosure provides a shoe insole in which one of the various components includes a discrete heel support member and a discrete heel guard member for providing therapeutic relief to a condition, pain, or discomfort of a user's heel.

An aspect of an example embodiment of the present disclosure is to provide a shoe insole including washable, reusable, and antimicrobial properties. Accordingly, the present disclosure provides a shoe insole in which the various therapeutic components include a freezable and/or microwavable material and that further includes a carrying case for storing the various components while not in use and while freezing.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION

Figure 5:
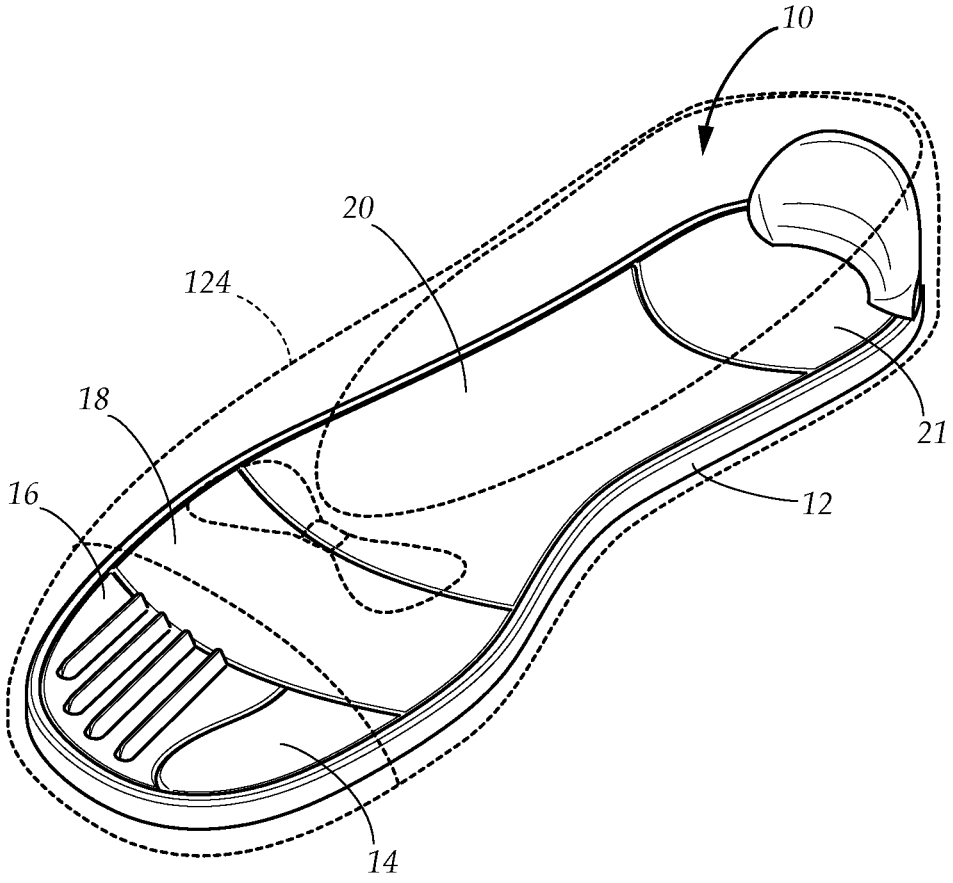
FIG. 5 is a top perspective partial phantom view of the modular shoe insole within the shoe illustrating the modular shoe insole fitting within the shoe according to one embodiment of the present disclosure.

FIG. 5 illustrates a foot therapy system comprising a shoe 124 and a modular shoe insole 10 inserted in the shoe 124. In embodiments, the shoe 124 comprises a spa shoe. In other embodiments, the shoe 124 comprises a slipper.

Figure 1:
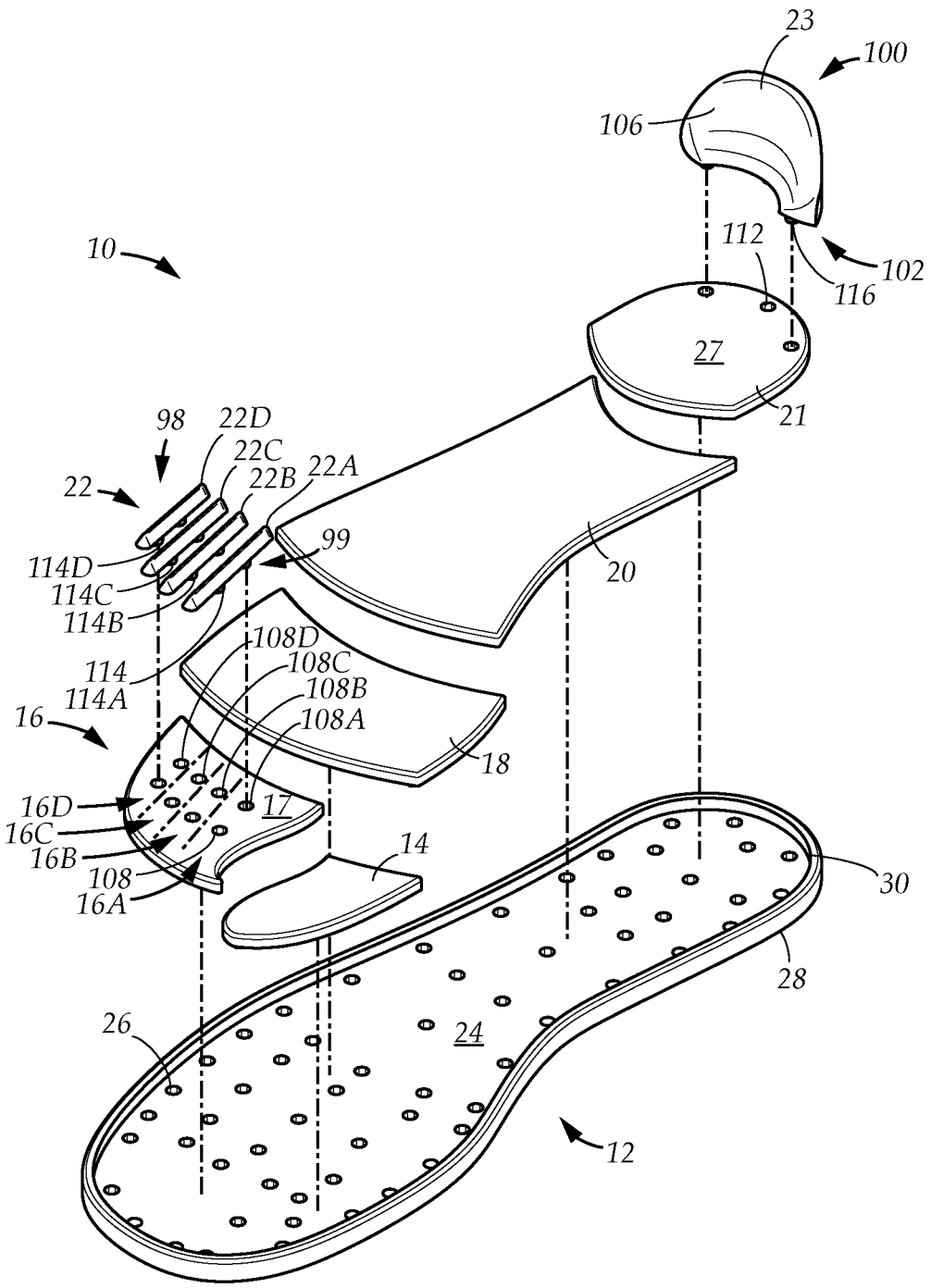
FIG. 1 is an exploded top perspective view of the modular shoe insole illustrating the therapeutic components of the insole according to one embodiment of the present disclosure.

FIG. 1 illustrates the modular shoe insole 10. The modular shoe insole 10 includes various removably attachable therapeutic components for customizing the modular shoe insole 10 to selectively target and obtain therapeutic relief from specific areas of a foot. The modular shoe insole 10 comprises a support frame 12 for removably receiving the various therapeutic components. The therapeutic components comprise a discrete first-toe support member 14, a discrete second-to-fifth-toe support member 16, a discrete ball-of-foot support member 18, a discrete arch support member 20, a discrete heel support member 21, a discrete toe divider 22, and a discrete heel guard member 23. The therapeutic components 14, 16, 18, 20, 21, 22, 23 are discrete in that they are separate and distinct components independent of one another.

In embodiments, the support frame 12 comprises a lower surface (not shown), an upper surface 24, a first fastener 26, and a perimeter edge 28. The fastener 26 is disposed on the upper surface 24. The perimeter edge 28 comprises a lip 30 extending around the perimeter edge 28. The lip 30 extends upwardly relative to the upper surface 24 of the support frame 12. In one embodiment, the lip 30 extends perpendicularly outwardly relative to the upper surface 24 of the support frame 12. The support frame 12 includes substantially the same shape as an insole of a shoe. The first fastener 26 interchangeably fastens the support frame 12 to the first-toe support member 14, the second-to-fifth-toe support member 16, the ball-of-foot support member 18, the arch support member 20, and the heel support member 21. In some embodiments, the support frame 12 comprises an insulated heating/cooling element for cold and/or heat therapy. In one embodiment, the heating/cooling element comprises an insulated gel layer enabling freezing or microwaving of the support frame 12 in order to cool or heat the support frame 12 for therapeutic purposes. In other embodiments, the support frame 12 comprises any known antimicrobial, washable material.

Figure 2:
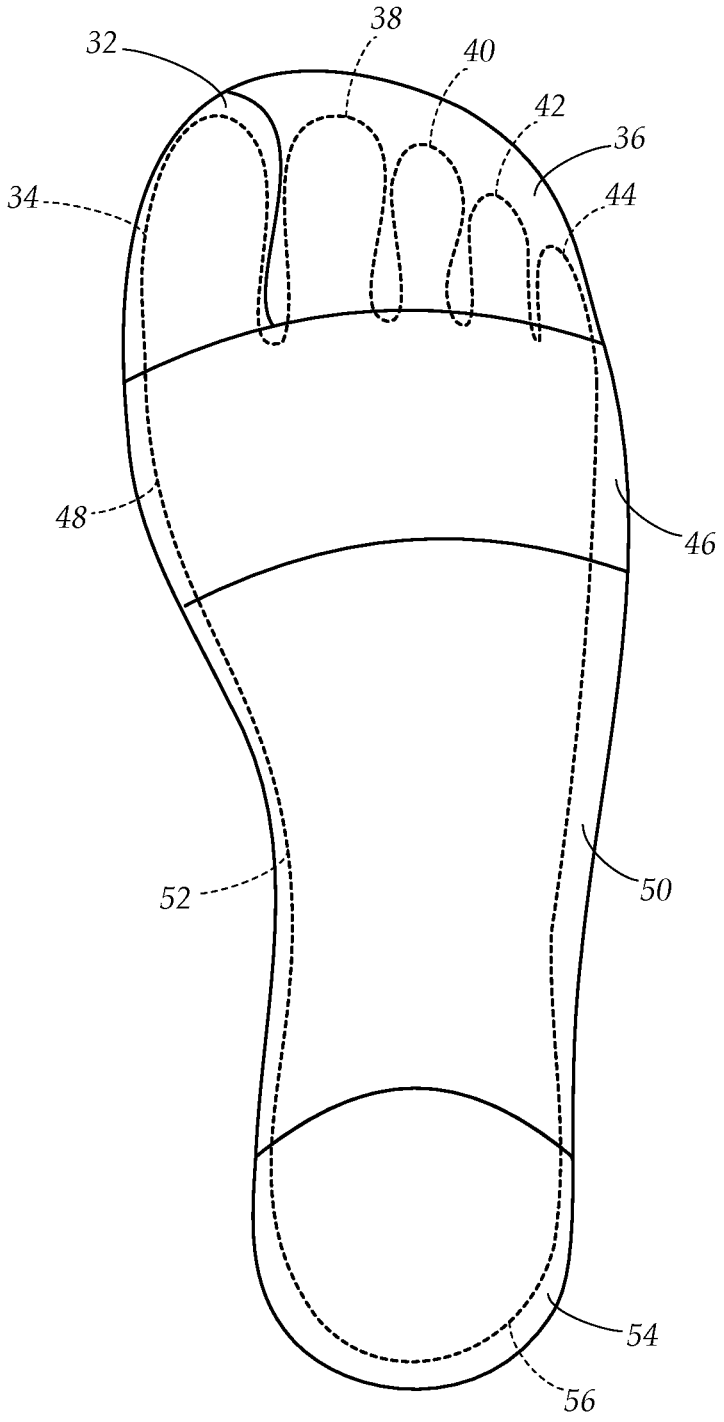
FIG. 2 is a bottom plan partial phantom view of the modular shoe insole illustrating the therapeutic components corresponding to the different areas of a foot according to one embodiment of the present disclosure.

Referring now to FIG. 2, the support frame (not shown) comprises a first-toe section 32 corresponding to a user's first toe 34 or "big toe", a second-to-fifth-toe section 36 corresponding to a user's second toe 38, third toe 40, fourth toe 42, and fifth toe 44, or "long toe," "middle toe," "ring toe," and "pinky toe," respectively, a ball-of-foot section 46 corresponding to the ball 48 of a user's foot, an arch section 50 corresponding to the arch 52 of a user's foot, and a heel section 54 corresponding to the heel 56 of a user's foot.

The first-toe support member (not shown) includes substantially the same shape as the first-toe section 32 such that the first-toe support member also corresponds to the user's first toe 34. The second-to-fifth-toe support member (not shown) includes substantially the same shape as the second-to-fifth-toe section 36 such that the second-to-fifth-toe support member also corresponds to the user's second toe 38, third toe 40, fourth toe 42, and fifth toe 44. The ball-of-foot support member (not shown) includes substantially the same shape as to the ball-of-foot section 46 such that the ball-of-foot support member also corresponds to the ball 48 of the user's foot. The arch support member (not shown) includes substantially the same shape as the arch section 50 such that the arch support member also corresponds to the arch 52 of the user's foot. The heel support member (not shown) includes substantially the same shape as the heel section 54, such that the heel support member also corresponds to the heel 56 of the user's foot.

Figure 3:
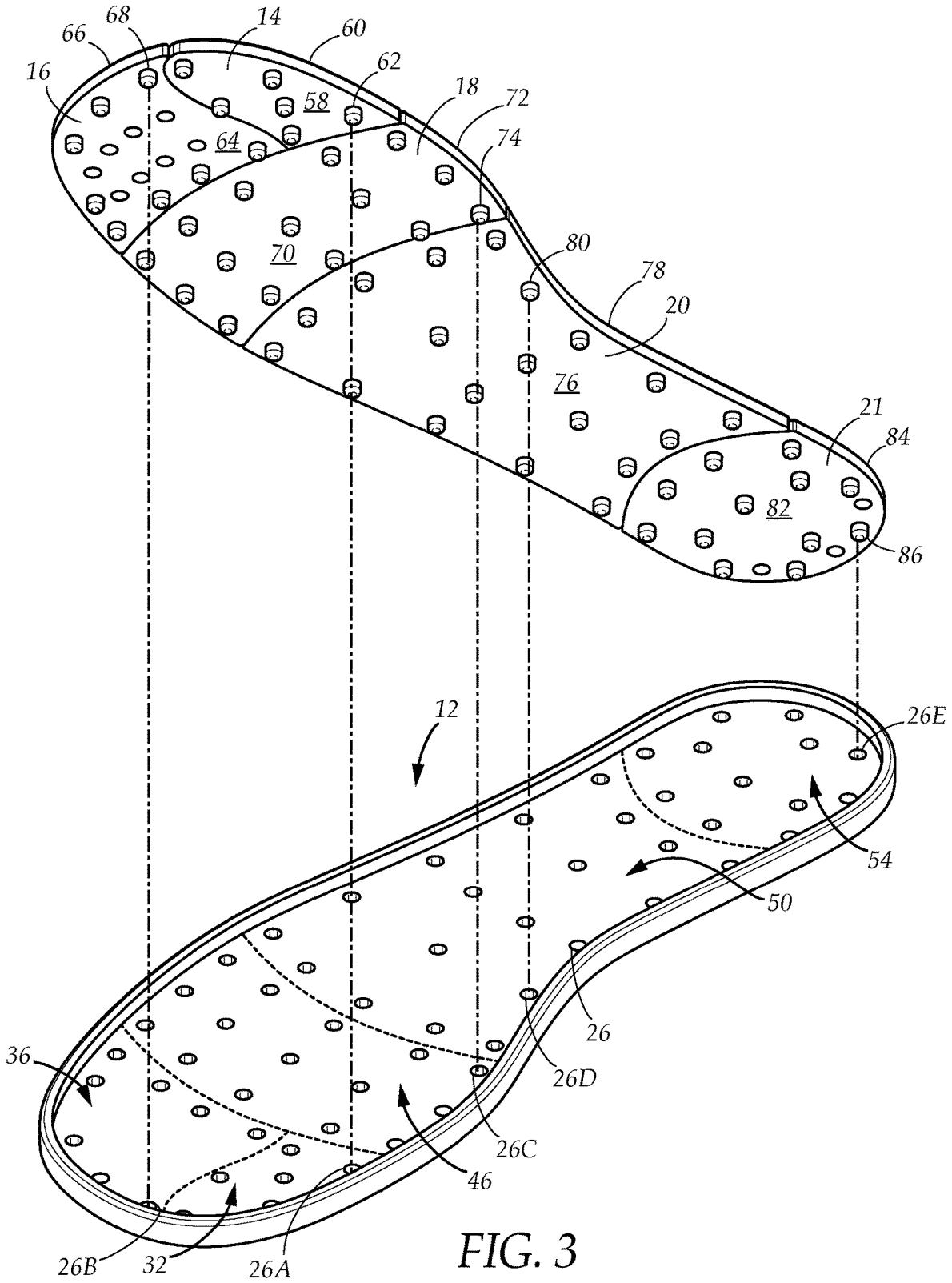
FIG. 3 is an exploded bottom perspective view of the modular shoe insole illustrating the manner in which the therapeutic components attach to the support frame of the modular shoe insole according to one embodiment of the present disclosure.

Referring now to FIG. 3, the first fastener 26 comprises a plurality of apertures including at least one aperture 26A disposed in the first-toe section 32, at least one aperture 26B disposed in the second-to-fifth-toe section 36, at least one aperture 26C disposed in the ball-of-foot section 46, at least one aperture 26D disposed in the arch section 50, and at least one aperture 26E disposed in the heel section 54.

The first-toe support member 14 is removably attachable to the first-toe section 32 of the support frame 12. The second-to-fifth-toe member 16 is removably attachable to the second-to-fifth-toe section 36 of the support frame 12. The ball-of-the-foot support member 18 is removably attachable to the ball-of-foot section 46 of the support frame 12. The arch support member 20 is removably attachable to the arch section 50 of the support frame 12. The heel support member 21 is removably attachable to the heel section 54 of the support frame 12. One or more of the first-toe support member 14, the second-to-fifth-toe support member 16, the ball-of-foot support member 18, the arch support member 20, and the heel support member 21 are attachable to the support frame 12 at the same time.

The first-toe support member 14 comprises an upper surface 15 (not shown), a lower surface 58, a perimeter edge 60, and a second fastener 62 for mating with the first fastener 26 of the support frame 12. The second-to-fifth-toe support member 16 comprises an upper surface 17 (not shown), a lower surface 64, a perimeter edge 66, and a third fastener 68 for mating with the first fastener 26 of the support frame 12. The ball-of-foot support member 18 comprises an upper surface 19 (not shown), a lower surface 70, a perimeter edge 72, and a fourth fastener 74 for mating with the first fastener 26 of the support frame 12. The arch support member 20 comprises an upper surface 25 (not shown), a lower surface 76, a perimeter edge 78, and a fifth fastener 80 for mating with the first fastener 26 of the support frame 12. The heel support member 21 comprises an upper surface 27 (not shown), a lower surface 82, a perimeter edge 84, and a sixth fastener 86 for mating with the first fastener 26 of the support frame 12.

In embodiments, the second fastener 62 comprises a protuberance disposed on the lower surface 58 of the first-toe support member 14. The third fastener 68 comprises a protuberance disposed on the lower surface 64 of the second-to-fifth-toe support member 16. The fourth fastener 74 comprises a protuberance disposed on the lower surface 70 of the ball-of-foot support member 18. The fifth fastener 80 comprises a protuberance disposed on the lower surface 76 of the arch support member 20. The sixth fastener 86 comprises a protuberance disposed on the lower surface 82 of the heel support member 21. The protuberance of the second fastener 62 mates with the at least one aperture 26A disposed in the first-toe section 32. The protuberance of the third fastener 68 mates with the at least one aperture 26B disposed in the second-to-fifth-toe section 36. The protuberance of the fourth fastener 74 mates with the at least one aperture 26C disposed in the ball-of-foot section 46. The protuberance of the fifth fastener 80 mates with the at least one aperture 26D disposed on the arch section 50. The protuberance of the sixth fastener 86 mates with the at least one aperture 26E disposed in the heel section 54.

Referring back to FIG. 1, the toe divider 22 is removably attachable to the second-to-fifth-toe support member 16 to separate a user's toes from one another. The heel guard member 23 is removably attachable to the heel support member 21 to protect a user's heel from a back of a shoe. The toe divider 22 comprises an upper end 98, a lower end 99, and a height that is substantially equal to the height of a user's toe. The heel guard member 23 comprises an upper end 100, a lower end 102 and an arcuate portion 106 disposed between the upper end 100 and the lower end 102 that includes a contour of a user's heel.

In embodiments, the second-to-fifth-toe support member 16 comprises a seventh fastener 108 for fastening the second-to-fifth toe support member 16 to the toe divider 22. The heel support member 21 comprises an eighth fastener 112 for fastening the heel support member 21 to the heel guard member 23. The toe divider 22 comprises a ninth fastener 114 for mating with the seventh fastener 108 of the second-to-fifth-toe support member 16. The heel guard member 23 comprises a tenth fastener 116 for mating with the eighth fastener 112 of the heel support member 21.

In embodiments, the seventh fastener 108 comprises an aperture disposed on the upper surface 17 of the second-to-fifth-toe support member 16. The eighth fastener 112 of the heel support member 21 comprises an aperture disposed on the upper surface 27 of the heel support member 21. The ninth fastener 114 of the toe divider 22 comprises a protuberance disposed on the lower end 99 of the toe divider 22 for mating with the aperture of the seventh fastener 108. The tenth fastener 116 of the heel guard member 23 comprises a protuberance disposed on the lower end 102 of the heel guard member 23 for mating with the aperture of the eighth fastener 112.

In embodiments, the toe divider 22 comprises a plurality of spacers including a first spacer 22A to divide the first toe of a user's foot from the second toe of the user's foot, a second spacer 22B to divide the second toe of the user's foot from the third toe of the user's foot, a third spacer 22C to divide the third toe of the user's foot from the fourth toe of the user's foot, and a fourth spacer 22D to divide the fourth toe of the user's foot from the fifth toe of the user's foot. The first spacer 22A, the second spacer 22B, the third spacer 22C, and the fourth spacer 22D each comprise the ninth fastener 114. In some embodiments, the first spacer 22A includes a protuberance 114A, the second spacer 22B includes a protuberance 114B, the third spacer 22C includes a protuberance 114C, and the fourth spacer 22D includes a protuberance 114D.

The second-to-fifth-toe support member 16 comprises a first region 16A corresponding to a space between the first toe and the second toe, a second region 16B corresponding to a space between the second toe and third toe, a third region 16C corresponding to a space between the third toe and fourth toe, and a fourth region 16D corresponding to a space between the fourth toe and the fifth toe.

The seventh fastener 108 of the second-to-fifth-toe support member 16 comprises a plurality of apertures disposed on the upper surface 17 of the second-to-fifth-toe support member 16 including a first aperture 108A disposed in the first region 16A, a second aperture 108B disposed in the second region 16B, a third aperture 108C disposed in the third region 16C, and a fourth aperture 108D disposed in the fourth region 16D. The protuberance 114A of the first spacer 22A mates with the first aperture 108A of the first region 16A. The protuberance 114B of the second spacer 22B mates with the second aperture 108B of the second region 16B. The protuberance 114C of the third spacer 22C mates with the third aperture 108C of the third region 16C. The protuberance 114D of the fourth spacer 22D mates with the fourth aperture 108D of the fourth region 16D.

Figure 4:
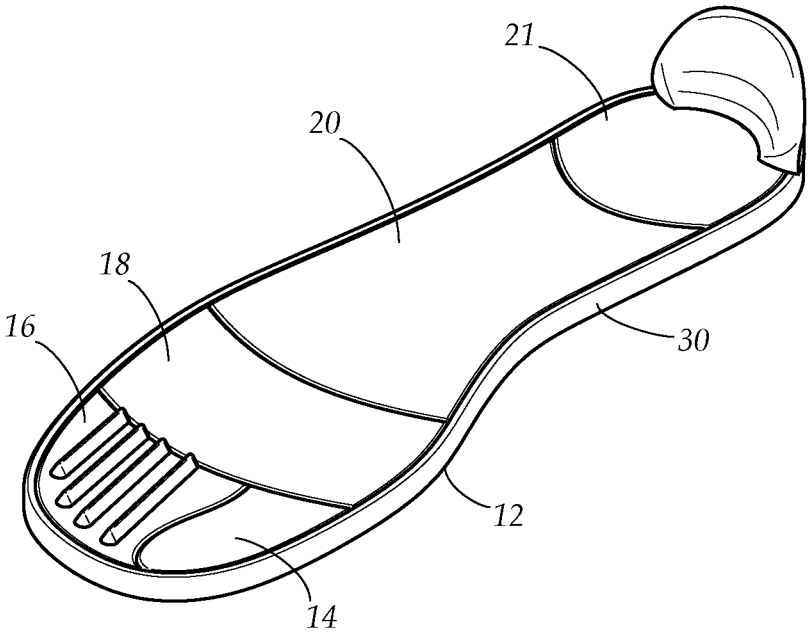
FIG. 4 is a top perspective view of the modular shoe insole illustrating the therapeutic components attached to the support frame according to one embodiment of the present disclosure.

Referring now to FIG. 4, the lip 30 abuts the perimeter edges of the first-toe support member 14, the second-to-fifth-toe support member 16, the ball-of-foot support member 18, the arch support member 20, and the heel support member 21 when either of the first-toe support member 14, the second-to-fifth-toe support member 16, the ball-of-foot support member 18, the arch support member 20, and the heel support member 21 are attached to the support frame 12. In embodiments, the lip 30 friction fits the first-toe support member 14, the second-to-fifth-toe support member 16, the ball-of-foot support member 18, the arch support member 20, and the heel support member 21 when they are attached to the support frame 12. When attached to the support frame 12 the first-toe support member 14, the second-to-fifth-toe support member 16, the ball-of-foot support member 18, the arch support member 20, and the heel support member 21 form substantially the same shape as the support frame 12. In embodiments, the first-toe support member 14, the second-to-fifth-toe support member 16, the ball-of-foot support member 18, the arch support member 20, and the heel support member 21 each include a height that is equal to the height of the lip 30, such that when the first-toe support member 14, the second-to-fifth-toe support member 16, the ball-of-foot support member 18, the arch support member 20, and the heel support member 21 are attached to the support frame 12 they are flush with the support frame 12.

FIG. 5 illustrates the modular shoe insole 10 inserted into the interior of the shoe 124 once assembled. In embodiments, a user employs the modular shoe insole 10 to achieve therapeutic relief from various sorts of conditions ailing the foot, such as high arch, flat foot, arthritis, and gout. Removal of one of the therapeutic components from an assembled modular shoe insole 10 creates a weight distribution on the other remaining components, thereby offsetting pressure to the area of a user's foot corresponding to the therapeutic components that has been removed. For example, in one embodiment, to achieve therapeutic relief from high arch, a user removes the arch support member 20 from the support frame 12 of an assembled modular shoe insole 10, which creates an even balance to the user's arch of the foot, thereby providing relief to the arch of the user's foot. In another embodiment, to achieve therapeutic relief from flat feet, a user removes the first-toe support member 14, the second-to-fifth-toe support member 16, the ball-of-foot support member 18, and the heel support member 21 from the support frame 12 of an assembled modular shoe insole 10, thereby leaving the arch support member 20 on the support frame 12 to create an arch in the insole 10 that provides relief. In yet another embodiment, to achieve therapeutic relief from arthritis or gout affecting the user's big toe, a user removes the first-toe support member 14 from the support frame 12 of the assembled modular shoe insole 10, thereby alleviating pressure on the big toe.

Figure 6:
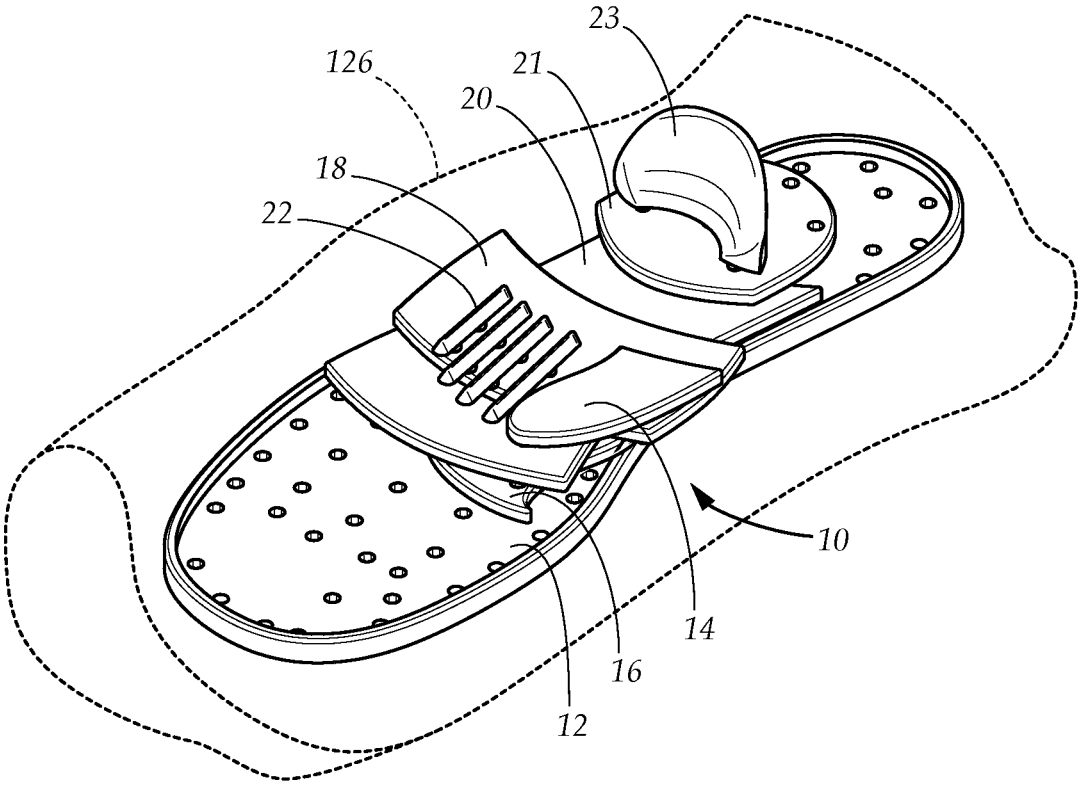
FIG. 6 is a top perspective partial phantom view of the modular shoe insole illustrating the modular shoe insole disassembled within the carrying case according to one embodiment of the present disclosure.

Referring now to FIG. 6, the modular shoe insole 10 comprises a case 126 for inserting the support frame 12 and the other therapeutic components 14, 16, 18, 20, 21, 22, 23 therein while the modular shoe insole 10 is not in use. In some embodiments, the case 126 comprises a carrying case for storing and transporting the modular shoe insole 10. In one embodiment, the case 126 comprises a washable nylon material. In other embodiments, the case 126 comprises a freezer case meant for storing the modular shoe insole 10 when freezing and separating the modular shoe insole 10 from food items in the freezer.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Moreover, "substantially" is defined as at least 95% of the term being described and/or "within a tolerance level known in the art and/or within 5% thereof.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a modular shoe insole for therapeutic use. The disclosure is illustrated by example in the drawing figures, and throughout the written description. It should be understood that numerous variations are possible, while adhering to the inventive concept. Such variations are contemplated as being a part of the present disclosure.

What is claimed is:

1. A foot therapy system, comprising:

a modular shoe insole comprising:

a support frame including a surface having a first-toe section, a second-to-fifth-toe section, a ball-of-foot section, an arch section, and a heel section;

one or more therapeutic components comprising:

a discrete first-toe support member including substantially the same shape as the first-toe section, the first-toe support member removably attachable to the first-toe section of the support frame, a discrete second-to-fifth-toe support member including substantially the same shape as the second-to-fifth-toe section, the second-to-fifth-toe member removably attachable to the second-to-fifth-toe section of the support frame, a discrete ball-of-foot support member including substantially the same shape as to the ball-of-foot section, the ball-of-the-foot support member removably attachable to the ball-of-foot section of the support frame, a discrete arch support member including substantially the same shape as the arch section, the arch support member removably attachable to the arch section of the support frame, a discrete heel support member including substantially the same shape as the heel section, the heel support member removably attachable to the heel section of the support frame, a discrete toe divider removably attachable to the second-to-fifth-toe support member to separate a user's toes from one another, and a discrete heel guard member removably attachable to the heel support member to protect a user's heel from a back of a shoe, wherein one or more of the first-toe support member, the second-to-fifth-toe support member, the ball-of-foot support member, the arch support member, and the heel support member are attachable to the support frame at the same time to provide relief to an area of a user's foot that corresponds to the particular support member attached to the support frame.

2. The modular shoe sole insert of claim 1, wherein:

the toe divider comprises an upper end, a lower end, and a height;

the heel guard member comprises an upper end, a lower end, and an arcuate portion disposed between the upper end and the lower end including a contour of a heel.

3. The modular shoe sole insert of claim 1, wherein the support frame comprises a first fastener for fastening the support frame to the first-toe support member, the second-to-fifth-toe support member, the ball-of-foot support member, the arch support member, and the heel support member.

4. The modular shoe sole insert of claim 3, wherein:

the first-toe support member comprises an upper surface, a lower surface, a perimeter edge, and a second fastener for mating with the first fastener of the support frame;

the second-to-fifth-toe support member comprises an upper surface, a lower surface, a perimeter edge, and a third fastener for mating with the first fastener of the support frame;

the ball-of-foot support member comprises an upper surface, a lower surface, a perimeter edge, and a fourth fastener for mating with the first fastener of the support frame;

the arch support member comprises an upper surface, a lower surface, a perimeter edge, and a fifth fastener for mating with the first fastener of the support frame; and the heel support member comprises an upper surface, a lower surface, a perimeter edge, and a sixth fastener for mating with the first fastener of the support frame.

5. The modular shoe sole insert of claim 4, wherein the support frame comprises a perimeter edge including a lip disposed around the perimeter edge, the lip extending upwardly from the edge and abutting the perimeter edges of one or more of the first-toe support member, the second-to-fifth-toe support member, the ball-of-foot support member, the arch support member, and the heel support member when the first-toe support member, the second-to-fifth-toe support member, the ball-of-foot support member, the arch support member, or the heel support member are attached to the support frame.

6. The modular shoe sole insert of claim 5, wherein:

the lip extends perpendicularly upwardly from the perimeter edge of the support frame; and the lip friction fits one or more of the first-toe support member, the second-to-fifth-toe support member, the ball-of-foot support member, the arch support member, and the heel support member when one or more of the first-toe support member, the second-to-fifth-toe support member, the ball-of-foot support member, the arch support member, and the heel support member are attached to the support frame.

7. The modular shoe sole insert of claim 4, wherein:

the first fastener comprises a plurality of apertures disposed on the surface of the support frame;

the second fastener comprises a protuberance disposed on the lower surface of the first-toe support member;

third fastener comprises a protuberance disposed on the lower surface of the second-to-fifth-toe support member;

fourth fastener comprises a protuberance disposed on the lower surface of the ball-of-foot support member;

the fifth fastener comprises a protuberance disposed on the lower surface of the arch support member; and the sixth fastener comprises a protuberance disposed on the lower surface of the heel support member.

8. The modular shoe sole insert of claim 7, wherein the plurality of apertures comprises at least one aperture disposed in the first-toe section, at least one aperture disposed in the second-to-fifth-toe section, at least one aperture disposed in the ball-of-foot section, at least one aperture disposed in the arch section, and at least one aperture disposed in the heel section.

9. The modular shoe sole insert of claim 8, wherein:

the protuberance of the second fastener mates with the at least one aperture disposed in the first-toe section;

the protuberance of the third fastener mates with the at least one aperture disposed in the second-to-fifth-toe section;

the protuberance of the fourth fastener mates with the at least one aperture disposed in the ball-of-foot section;

the protuberance of the fifth fastener mates with the at least one aperture disposed on the arch section; and the protuberance of the sixth fastener mates with the at least one aperture disposed in the heel section.

10. The modular shoe sole insert of claim 9, wherein:

the second-to-fifth toe support member further comprises a seventh fastener for fastening the second-to-fifth toe support member to the toe divider; and the heel support member further comprises an eighth fastener for fastening the heel support member to the heel guard member.

11. The modular shoe sole insert of claim 10, wherein:

the toe divider comprises a ninth fastener for mating with the seventh fastener; and the heel guard member comprises a tenth fastener for mating with the eighth fastener.

12. The modular shoe sole insert of claim 11, wherein:

the seventh fastener of the second-to-fifth-toe support member comprises an aperture disposed on the upper surface of the second-to-fifth-toe support member; and the eighth fastener of the heel support member comprises an aperture disposed on the upper surface of the heel support member.

13. The modular shoe sole insert of claim 12, wherein:

the ninth fastener of the toe divider comprises a protuberance disposed on the lower end of the toe divider for mating with the aperture of the seventh fastener;

the tenth fastener of the heel guard member comprises a protuberance disposed on the lower end of the heel guard member for mating with the aperture of the eighth fastener.

14. The modular shoe sole insert of claim 13, wherein the toe divider comprises a plurality of spacers including at least two of a first spacer to divide the first toe from the second toe, a second spacer to divide the second toe from the third toe, a third spacer to divide the third toe from the fourth toe, and a fourth spacer to divide the fourth toe from the fifth toe.

15. The modular shoe sole insert of claim 14, wherein the seventh fastener of the second-to-fifth-toe support member comprises a plurality of apertures disposed on the upper surface of the second-to-fifth-toe section.

16. The modular shoe sole insert of claim 15, wherein the second-to-fifth-toe support member comprises a first region adapted to be positioned between the first toe and the second toe, a second region adapted to be positioned between the second toe and third toe, a third region adapted to be positioned between the third toe and fourth toe, and a fourth region adapted to be positioned between the fourth toe and the fifth toe.

17. The modular shoe sole insert of claim 16, wherein the plurality of apertures of the second-to-fifth-toe support member include a first aperture disposed in the first region, a second aperture disposed in the second region, a third aperture disposed in the third region, and a fourth aperture disposed in the fourth region.

18. The modular shoe sole insert of claim 17, wherein the first spacer, the second spacer, the third spacer, and the fourth spacer each comprise a protuberance disposed on the lower end thereof.

19. The modular shoe sole insert of claim 18, wherein:

the protuberance of the first spacer mates with the first aperture of the first region;

the protuberance of the second spacer mates with the second aperture of the second region;

the protuberance of the third spacer mates with the third aperture of the third region; and the protuberance of the fourth spacer mates with the fourth aperture of the fourth region.

* * * * *